United States Patent [19]

Gabriel

[11] Patent Number: 4,598,720

[45] Date of Patent: Jul. 8, 1986

[54] PELLETED CIGARETTE

[76] Inventor: Naeem B. Gabriel, 2 Kingsbury Sq., Apt. #19-E, Trenton, N.J. 08611

[21] Appl. No.: 605,257

[22] Filed: Apr. 29, 1984

Related U.S. Application Data

[63] Continuation-in-part of Ser. No. 230,360, Jan. 30, 1981.

[51] Int. Cl.[4] ..... A24D 3/04

[52] U.S. Cl. ..... 131/335; 131/360

[58] Field of Search ..... 131/360, 363, 364, 365, 131/341, 335, 342, 343, 352, 361, 362

[56] References Cited

U.S. PATENT DOCUMENTS 2,976,190 5/1957 Meyer ..... 131/342
3,339,558 9/1967 Waterbury ..... 131/335
3,603,319 9/1971 Badgett ..... 131/342
4,300,576 11/1981 Vander Loo et al. ..... 131/335

*Primary Examiner*—V. Millin
*Assistant Examiner*—H. Macey

[57] ABSTRACT

A substantial amount of tar, nicotine, and some other hydrocarbons in the smoke of a cigarette could be condensed on a metallic surface, if that metallic surface is properly positioned inside that cigarette.

The metallic surface in this disclosure may be porous pellets of aluminum foil which may be scattered amid the tobacco of the cigarette, or they may be axially arranged as a column in the cigarette. Also, using these porous pellets of aluminum foil in a cigarette can find a use in medicine, as they may be filled with a dosage of a medicament.

1 Claim, 3 Drawing Figures

PELLETED CIGARETTE

CROSS-REFERENCE TO RELATED APPLICATIONS

This is a continuation in part application to its parent application Ser. No. 06/230,360—which was filed on Jan. 30, 1981.

BACKGROUND OF THE INVENTION (1) Field of the Invention

It relates to cigarettes, and more specifically to a novel method to clean the smoke of cigarettes.

By putting some porous pellets from aluminum foil amidst the tobacco in the cigarette, the amount of tar; nicotine; and some other hydrocarbons in the smoke are reduced to a minimum by their condensation and trapping them inside these porous pellets.

Add to that; by filling these porous pellets with certain medicaments; the cigarette may have an application in medicine to treat some specific ailments in the body.

(2) Description of the Prior Art

There were inventions which dealt with the subject of cleaning the smoke of the cigarette before inhalation.

Some of them introduced chemically treated tobacco, whereas others offered chemically treated paper wrappers.

An example for that is U.S. Pat. No. 3,106,210 by Renolds. In his novel cigarette Renolds included in it activated alumina, bauxite, gum, and some bulky material dyed with either ferric ammonium oxalate, mono azo dyestuff, sorbitol or carboxymethyl cellulose.

Some other inventions used paper wrappers electroplated or laminated with a metallic layer or which incorporated metallic powder inside the paper wrapper; such as U.S. Pat. No. 3,106,210 by Renolds. Some other inventors perforated the paper wrapper as in U.S. Pat. No. 3,046,996 by Schur, or Harris in his U.S. Pat. No. 439,004—or the French Pat. No. 998,557 or the two Belgian Pat. Nos. 568,149 and 570,440.

In U.S. Pat. Nos. 3,370,593 and 3,409,021 by Owaki, he used metallic strips or bands which he adhered to the paper wrapper, and he claimed that these metallic bands must be three times as wide as the intervening bands of the paper.

In another U.S. invention by Meyer U.S. Pat. No. 2,976,190, he developed a cigarette in which he intermixed with the tobacco metal particles throughout the entire length and breadth of the cigarette. Meyer also offered that the paper wrapper be completely coated on one side with metallic bodies or particles such as metallic aluminum foil.

SUMMARY OF THE NEW EMBODIMENT

The new embodiment submitted here accounted for some points in which the prior art as was disclosed failed to achieve. The main key issues which are targets for that novel embodiment provide that:

(a) any metallic body introduced in the tobacco of that cigarette must allow for good ventillation to the burning tobacco;

(b) that metallic body must not interfere with the burning of the tobacco;

(c) that metallic body must be properly positioned in a cigarette in a manner that will not increase the amount of carbon monoxide from being developed;

(d) the novel method may have an application in medicine;

(e) the method must be effective in reducing the amounts of tar and nicotine in the smoke.

In my method I used some small porous pellets of aluminum foil. These porous pellets were prepared by crushing aluminum foil; small pieces were cut from that crushed foil to form small porous pellets.

A number of these porous pellets were stacked one over another to form a column. That column is axially positioned in the middle of the tobacco in the cigarette along its length.

In another arrangement some of these porous pellets may also be stuffed over the tobacco, as a mouth-piece filter to the inhaled smoke.

Thirdly the porous pellets may be scattered in the tobacco. The novel embodiment provides good ventillation for the lighted cigarette, and also prepares a relatively cold surface for the condensation of most of the tar, and the nicotine inside the pores and grooves of these porous pellets.

Beside that objective, the new method finds an application in medicine wherein certain medicaments may be introduced in the cigarette inside these porous pellets.

Not only does this novel method provide for cleaning the smoke or be of that special use in medicine, but it is also economic, and comparatively healthier. The quantity of the tobacco in the cigarette comes less, compared to the conventional cigarette of a similar size. Add to that; the aroma of the tobacco stays natural and discarding of the ashes will not be a problem.

BRIEF DESCRIPTION OF THE DRAWINGS

FIG. (1) is a cross-section view in the novel cigarette, where 1 is its paper wrapper, and 2 is the tobacco which fills it, and 3 are porous pellets stacked one over the other to form a column, and whereas that column is axially positioned amidst the tobacco in that cigarette; along its length.

FIG. (2) is a cross-section view in the novel cigarette, where 1 is its paper wrapper, and 2 is the tobacco which fills it, and 3 are porous pellets stacked one over the other to form a column. That column of the stacked porous pellets is axially positioned amidst the tobacco in the cigarette along its length; and in addition: some of these porous pellets are stuffed over the tobacco column as a mouth piece filter 4, for an extra filtration to the smoke.

FIG. (3) is a cross-section view in the novel cigarette, where 1 is the paper wrapper, and 2 is the tobacco which fills it, and 3 are small porous pellets which are scattered amidst the tobacco.

DESCRIPTION OF THE PREFERRED EMBODIMENT

This new development is a successful effort to fill a need and achieve a function wherein the prior art as was disclosed failed to fulfill.

The former objectives which were mentioned before; were shaped in a novel embodiment which uses some unshapely porous pellets with grooves in them. These porous pellets may be obtained by cutting small pieces from wrinkled and crushed aluminum foil. Evidently with the aluminum foil being crushed, the pellets cut from it will have grooves in them, and be porous, and also they will include within them an amount of air; beside being light in weight.

In order that these porous pellets do not interfere with the normal burning of the tobacco; if they were found in a cigarette; three options were set here for their arrangement. Firstly as shown in FIG. (1) the porous pellets 3 are put amidst the tobacco 2 with the paper wrapper 1 containing them all. Here the porous pellets 3 in FIG. (1) are stacked one over the other as a column which is axially positioned in the tobacco along the length of the cigarette.

The air in these porous pellets will be a good ventillation means to the burning tobacco; upon lighting the cigarette.

It should be noticed that the size of each pellet should be small, preferably with a diameter that is approximately one quarter of that of the cigarette.

Figure 1:
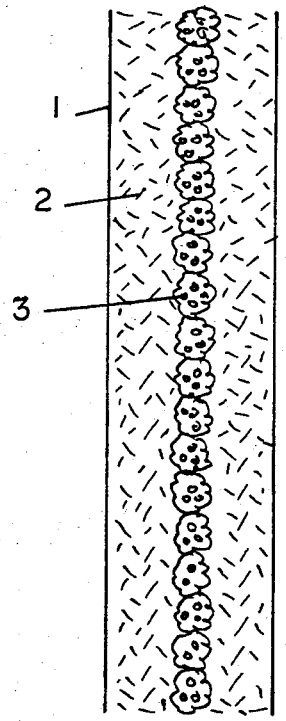
Figure 2:
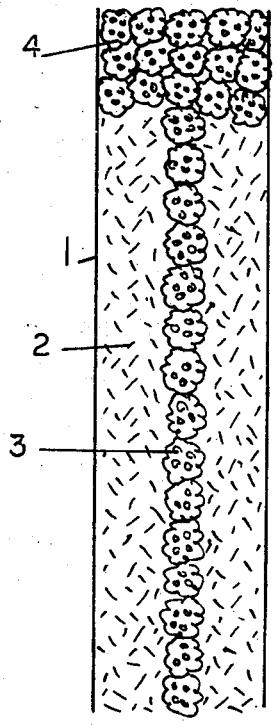

Secondly, in addition to the stack of the porous pellets 3 FIG. 2 which were axially positioned amidst the tobacco 2 FIG. 2 in the cigarette, some additional porous pellets were put over the tobacco to form a sort of a mouth piece filter 4 FIG. 2 to the smoke.

Figure 3:
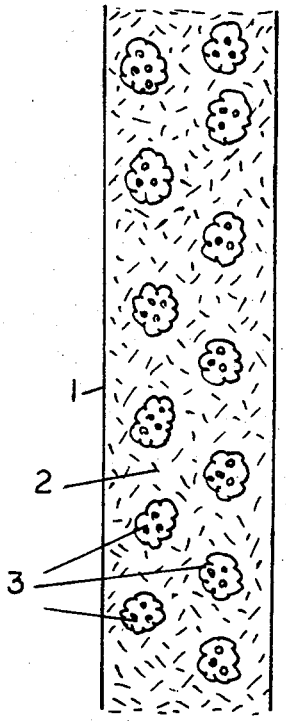

In a third different arrangement, a few of these porous pellets 3 FIG. 3 may be scattered amidst the tobacco 2 FIG. 3, with the paper wrapper enclosing them all 1 FIG. 3.

When smoking a cigarette of that novel structure, tar and nicotine in the smoke will find a place to condense in those grooves or in that porous surface of these pellets.

It is clear that discarding of the ashes does not constitute a problem.

Because the stack of the porous pellets which is axially arranged amidst the tobacco has a good capacity to buffer the rise in the temperature; resulting from the burning tobacco; that allows them to function well as a good condensation means.

Therefore a big portion of the tar and nicotine will be condensed on that colder surface closer to the combustion zone, before they evaporate in a later stage when that burning cigarette becomes shorter and shorter thereafter.

Moreover than that; the trapped nicotine and tar captured inside the porous pellets will not allow them to easily evaporate, which constitutes a means to drain them with the ashes.

Another unique feature of the pelleted cigarette is that it finds a special use in medicine. The porous pellets other than being bags filled with air present amidst the tobacco, they may include within them a dosage of a certain medicament; whether that medicament is in a liquid or solid form.

When smoking a cigarette of that kind; the heat from the burning tobacco releases the vapor of these medicinals along with the smoke which will be effective in treating some ailments or diseases in the smoker.

For an example only but not to enumerate them; there are in the market medicinals to be taken by inhalation as vapor or mist; such as nasal sprays, cold reliefs, sedatives, vasodilators inhalators for angina, astma, coughs, vasoconstrictors, antispasmodics, antihistamines, central nervous system stimulants, sedatives, anticonvulsants, and many more.

Some are freely sold over the counter, such as mint oil, camphor oil of dwarf pine, others like eucalyptol or guayacol. Some are restricted and require an observation by a treating physician such as adreno-mist, mistol mist, and radio-active iodine . . . etc.

I claim:

1. A cigarette comprising a paper wrapper which circumscribes a tobacco column, a plurality of pellets positioned within the tobacco column and arranged substantially linearly along the longitudinal axis of the tobacco column, said pellets comprising crushed aluminum foil so as to provide a porous structure, said pellets further comprising a medicinal substance contained in the porous structure.

* * * * *